US008002584B1

(12) United States Patent
Hsu et al.

(10) Patent No.: US 8,002,584 B1
(45) Date of Patent: Aug. 23, 2011

(54) CONNECTOR

(75) Inventors: Ya Hui Hsu, Taipei (TW); Mei Chuan Yang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/916,846

(22) Filed: Nov. 1, 2010

(51) Int. Cl.
*H01R 24/00* (2006.01)

(52) U.S. Cl. ..... 439/626

(58) Field of Classification Search ..... 439/626, 439/630, 541.5, 941, 76.1
See application file for complete search history.

(56) References Cited

U.S. PATENT DOCUMENTS

2008/0124977 A1* 5/2008 Peng et al. ..... 439/626
2008/0268711 A1* 10/2008 Miyazaki et al. ..... 439/626
2009/0081903 A1* 3/2009 Zhang et al. ..... 439/626
2010/0055984 A1* 3/2010 Tsuchida et al. ..... 439/626
2010/0227507 A1* 9/2010 Cheng et al. ..... 439/626
2010/0248549 A1* 9/2010 Lim ..... 439/626

* cited by examiner

*Primary Examiner* — Jean Duverne
(74) *Attorney, Agent, or Firm* — WPAT. P.C.; Anthony King

(57) ABSTRACT

A connector has a top housing, a plurality of terminals mounted in the top housing. The top housing forms a plurality of receiving passages therethrough. Two sides of a bottom of the receiving passage are recessed outward to form two pairs of fixing recesses. One end of the receiving passage has a top portion protruding inward to form a resting portion. The terminal has a holding slice having lateral sides extended outward to form two pairs of fixing slices. The holding slice connects with an elastic arm of substantially inverted-V shape with an opening facing to the holding slice. The holding slice is located at a bottom of the receiving passage with the fixing slice received in the holding recess for fix the terminal in the top housing. The elastic arm rests against the resting portion for preventing the deformation of the terminal by the pulling of the terminal.

4 Claims, 6 Drawing Sheets

CONNECTOR

BACKGROUND OF THE INVENTION

1. Field of the Invention

The present invention relates to an electrical connector, and more particularly to a connector capable of avoiding the deformation of terminals.

2. The Related Art

Referring to FIG. 9, a conventional connector 100' has an insulating housing 10'. The insulating housing 10' is formed with a plurality of receiving passages 11' therethrough. A plurality of terminals 20' is mounted in the receiving passages 11'. The terminal 20' has a holding slice 21'. A free end of the holding slice 21' is connected with an elastic arm 22' of substantially inverted-V shape with an opening facing to the holding slice 21'. The elastic arm 22' has an apex formed with a contacting portion 23'. While assembling the terminal 20', the holding slice 21' is received in the receiving passage 11' while the contacting portion 23' stretching out of the insulating housing 10'. However, the terminal 20' may be out of shape affected by the pulling of the contacting portion 23' by an external force.

SUMMARY OF THE INVENTION

Accordingly, an object of the present invention is to provide a connector. The connector has a top housing, a plurality of terminals mounted in the top housing. The top housing is recessed to form a plurality of receiving passages therethrough. Two sides of a bottom of the receiving passage are recessed outward to form at least one pair of fixing recesses. One end of the receiving passage has a top portion protruding inward to form a resting portion. The terminal has a holding slice located at a bottom of the receiving passage. The holding slice has lateral sides extended outward to form at least one pair of fixing slices fixed in the holding recesses. One end of the holding slice is connected with an elastic arm of substantially inverted-V shape with an opening facing to the holding slice. The elastic arm has a lower portion adjacent to a joint between the elastic arm and the holding slice resting against a bottom of the resting portion.

As described above, the fixing slice is received in the holding recess to fix the terminal in the top housing. The elastic arm rests against the resting portion for preventing the deformation of the terminals affected by the pulling of the terminal by an external force.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
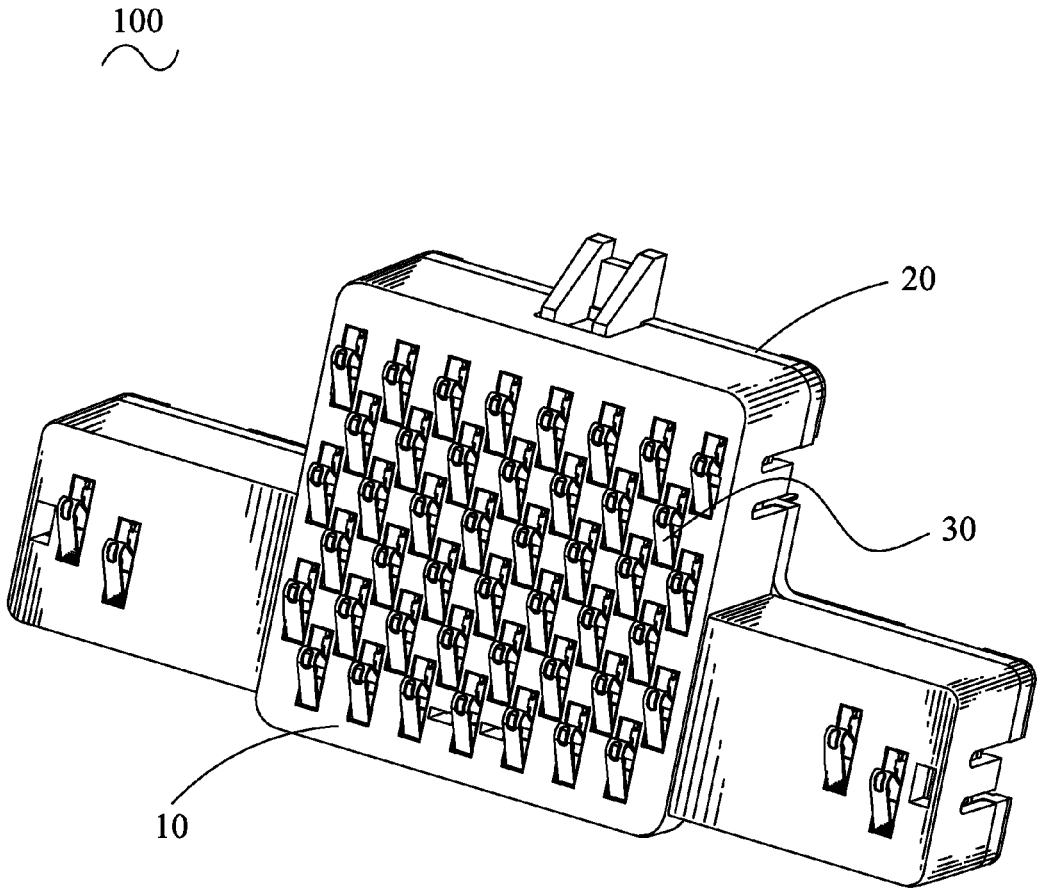
FIG. 1 is an assembled, perspective view of a connector of an embodiment in accordance with the present invention.
Figure 2:
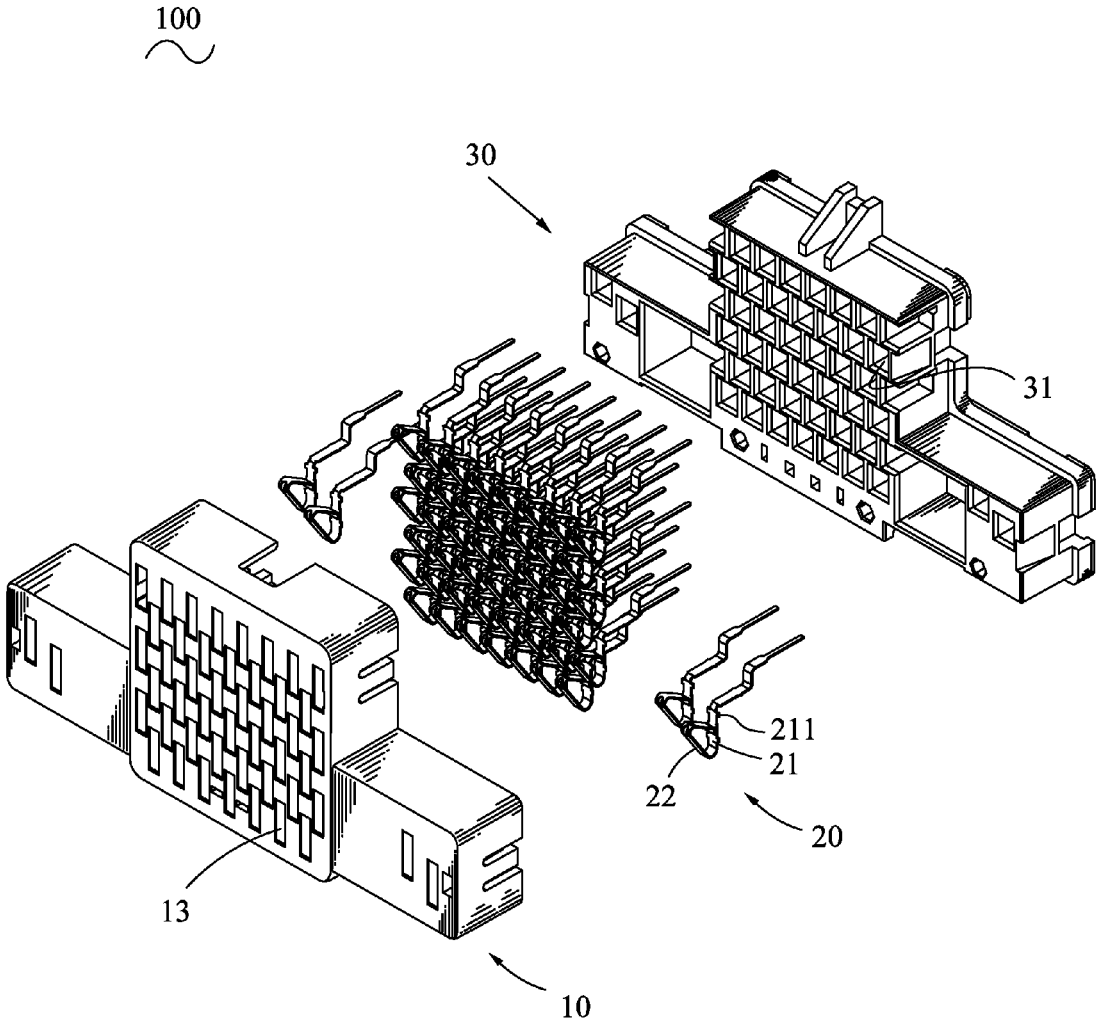
FIG. 2 is an exploded, perspective view of the connector shown in FIG. 1.

Referring to the drawings in greater detail, and first to FIGS. 1-2, the embodiment of the invention is embodied in a connector 100. The connector 100 has a top housing 10, a bottom housing 30 coupled with the top housing 10, a plurality of terminals 20 mounted in the top housing 10.

Figure 5:
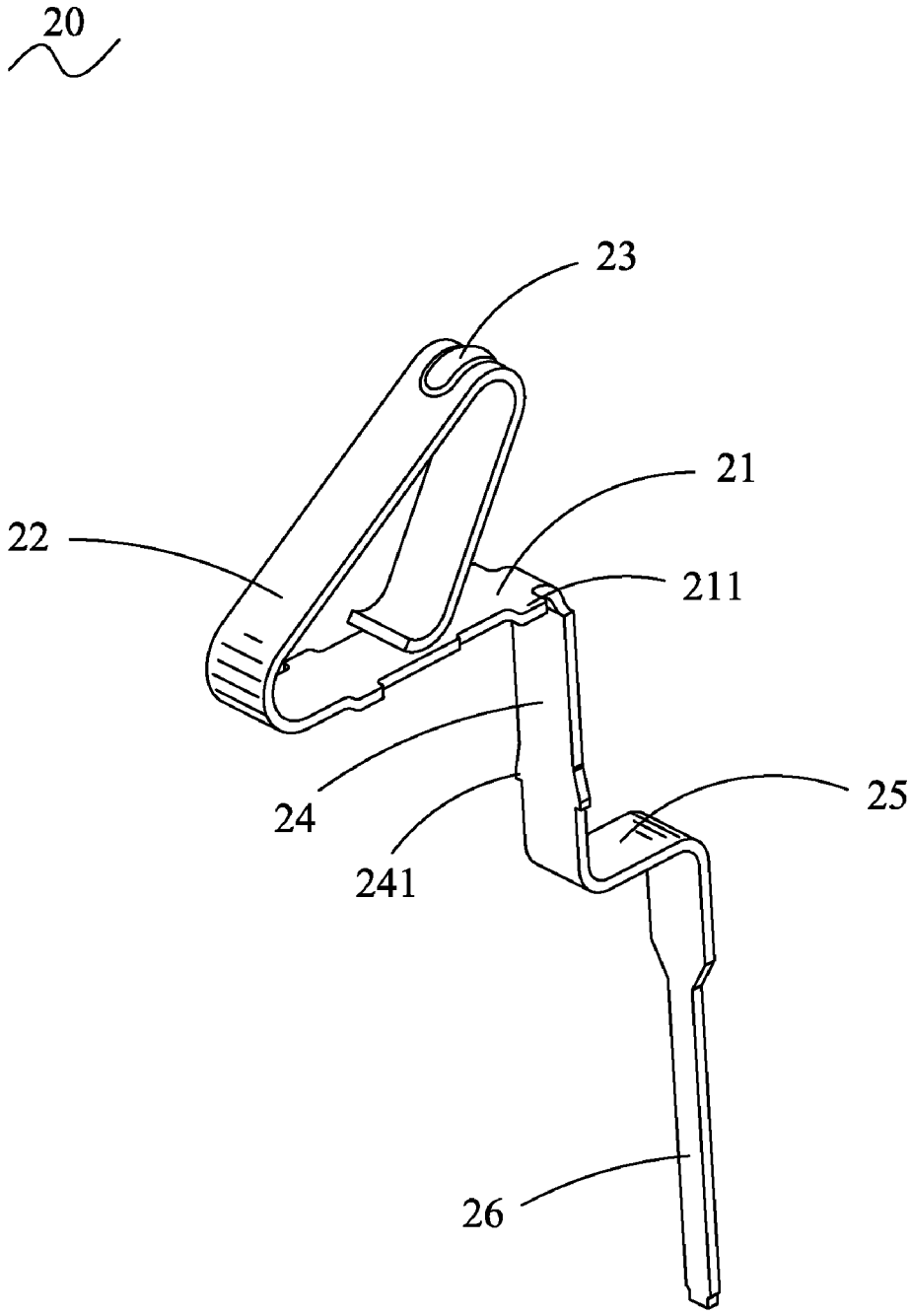
FIG. 5 is a perspective view of a terminal shown in FIG. 2.

With reference to FIG. 5, the terminals 20 fixed in the top housing 10 has a base slice 24 which has barbs 241 formed at a substantially middle portion thereof. A top end of the base slice 24 is extended perpendicularly to form a holding slice 21 having a free end connecting with an elastic arm 22 of substantially inverted-V shape with an opening facing to the holding slice 21. The elastic arm 22 has an apex formed with a contacting portion 23. A bottom of the base slice 24 is extended opposite to the holding slice 21 to form an extending slice 25. A free end of the extending slice 25 is extended downward to form a soldering slice 26 of strip shape. Two pairs of opposite fixing slices 211 are extended outward from two lateral sides of the holding slice 21.

Figure 3:
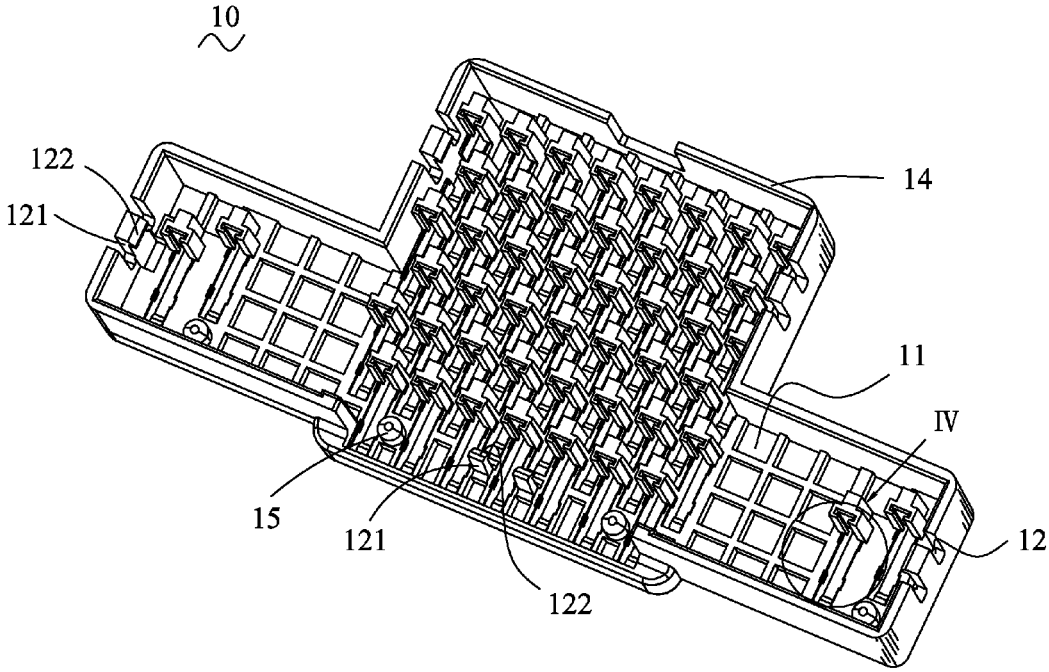
FIG. 3 is a perspective view of a top housing of the connector shown in FIG. 2.
Figure 4:
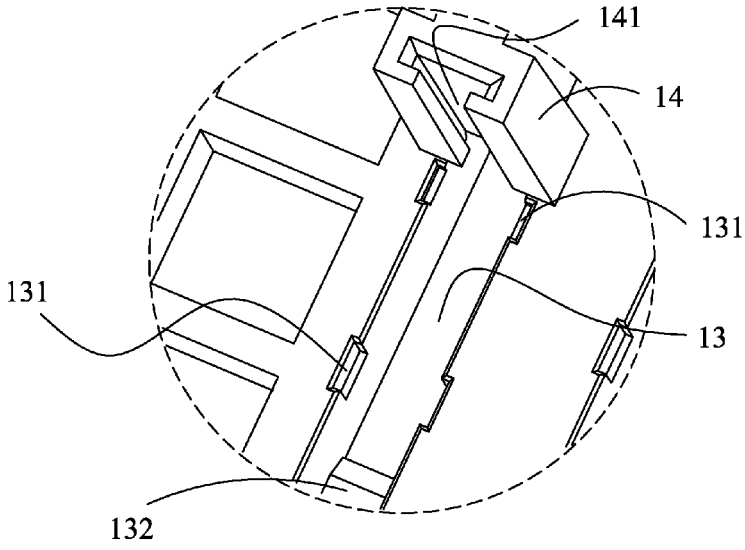
FIG. 4 is a partly enlarged view showing an enlarged IV portion of FIG. 3.

Referring to FIGS. 3-4, a bottom of the top housing 10 is recessed to form a receiving space 11 surrounded by a frame 14. The frame 14 forms a plurality of gaps 12. A middle portion of the gap 12 is extended beyond the frame 14 to form a fixing rail 121 having a free end formed with a wedge 122. The receiving space 11 is also formed with a plurality of fixing rails 121 and pegs 15. In this embodiment, a pair of fixing rails 121 is formed at two opposite sides of the frame 14. Two pairs of pegs 15 are formed at the receiving space 11 at intervals. A pair of fixing rails 121 is located between two pegs 15.

A middle portion of the top housing 10 is formed with a plurality of receiving passages 13 through the top housing 10 and communicating with the receiving space 11. A plurality of fixing portions 14 are extended downward from a top wall of the receiving space 11 and adjacent to one end of the respective receiving passages 13. A surface of the fixing portion 14 facing the receiving passage 13 defines a fixing recess 141 penetrating a top and a bottom of the fixing portion 14. One end of the receiving passage 13 opposite to the fixing portion 14 has a top portion protruded inward to form a resting portion 132. A middle portion of a bottom of the receiving passage 13 is recessed to form two pairs of holding recesses 131 corresponding to the fixing slices 211.

Figure 6:
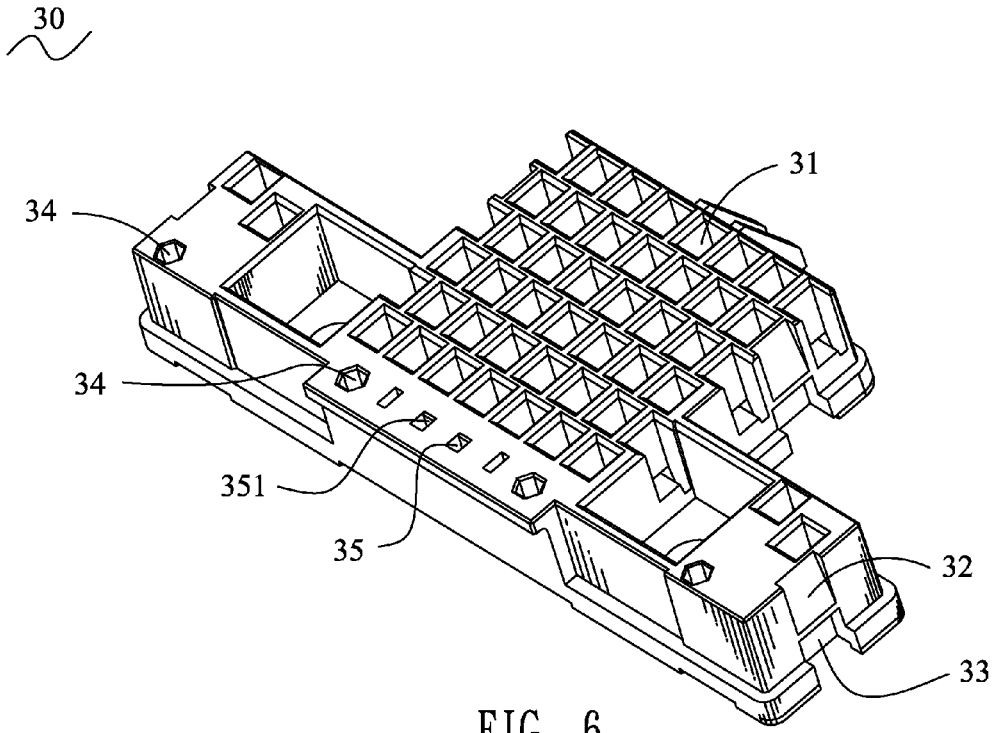
FIG. 6 is a perspective view of a bottom housing of the connector shown in FIG. 2.
Figure 7:
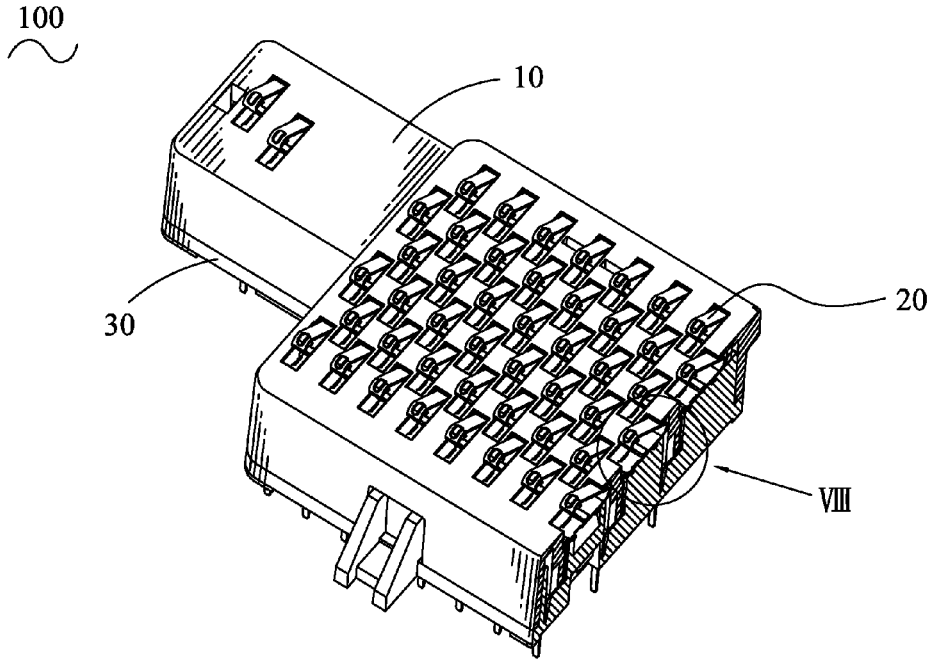
FIG. 7 is a cross-sectional view of the bottom housing having a plurality of terminals mounted therein.
Figure 8:
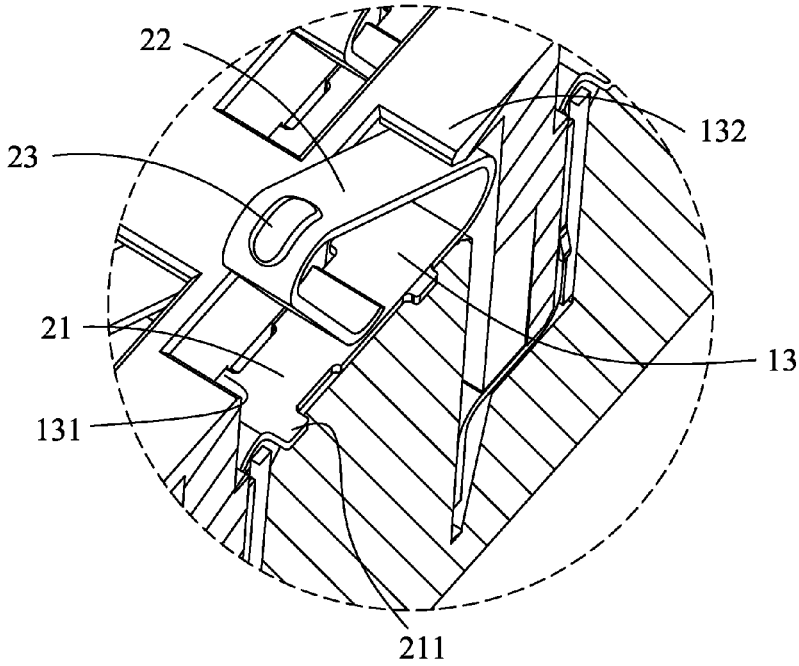
FIG. 8 is a partly enlarged view showing an enlarged VIII portion of FIG. 7.
Figure 9:
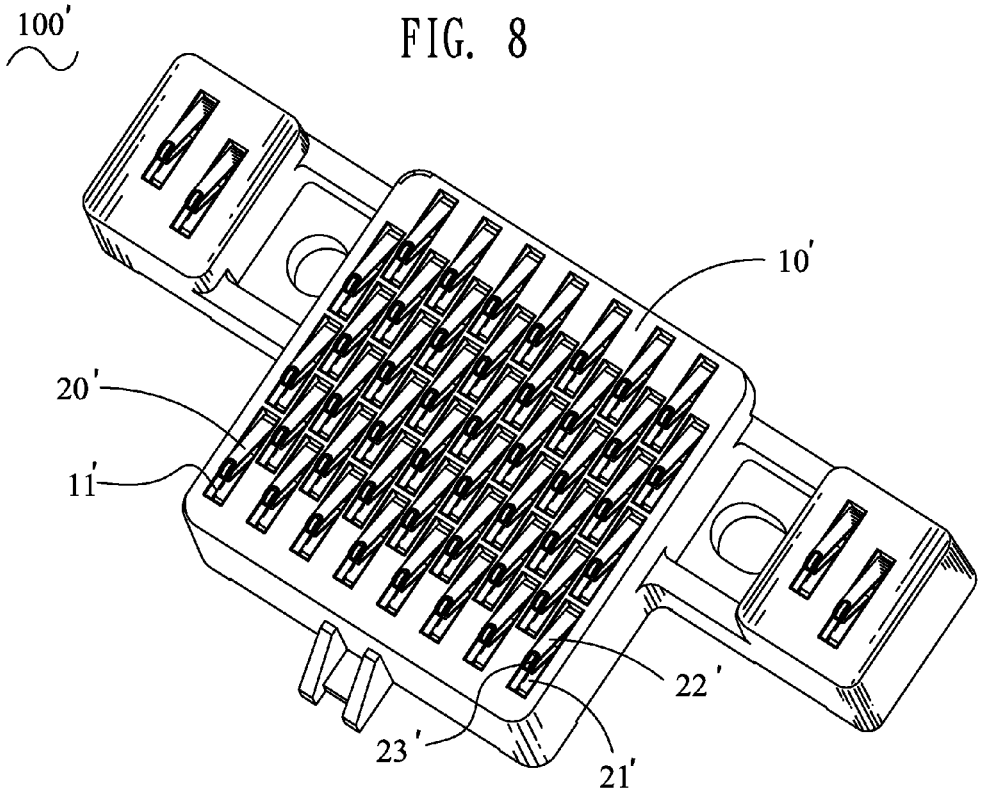
FIG. 9 (Prior Art)
FIG. 9 is a perspective view of a conventional connector.

Please refer to FIGS. 6-7, the bottom housing 30 assembled to the bottom of the top housing 10 has a middle portion recessed to form a plurality of receiving holes 31 corresponding to the fixing portions 14. Corresponding to the pegs 15, a plurality of positioning holes 34 is formed at the bottom housing 30. A pair of fixing holes 35 is formed at the bottom housing 30 for receiving the fixing rails 121. A guiding block 351 is protruded from a side of the fixing hole 35. Corresponding to each fixing rail 121, a guiding recess 32 is formed at the periphery of the bottom housing 30 for guiding the fixing rail 121 while assembling the bottom housing 30 to the top housing 10. A bottom of the guiding recess 32 is further recessed to form a buckling recess 33 buckling with the wedge 122 for fixing the top housing 10 on the bottom housing 30 firmly.

With reference to the FIGS. 3-8, in assembly, the terminals 20 are assembled into the top housing 10 from the bottom of the top housing 10. The base slice 24 is inserted into the fixing recess 141 with the barbs 241 interfering with the lateral sides of the fixing recess 141 so as to fix the base slice 24 firmly in the fixing recess 141. The elastic arm 22 has a lower portion adjacent to a joint between the elastic arm 22 and the holding slice 21 resting against the resting portion 132. The contacting portion 23 stretches out of the top housing 10. The holding slice 21 is located at a bottom of the receiving passage 13 with the fixing slices 211 received in the holding recess 131. The extending slice 25 is located at the bottom of the fixing portion 14 and held in a bottom of the receiving hole 31, meanwhile, the soldering slice 26 penetrates and exposes outside the bottom housing 30.

While the bottom housing 30 is assembled to the top housing 10, the fixing portion 14 is received in the corresponding receiving hole 31. The pegs 15 are received in the positioning holes 34. The fixing rails 121 locating at two opposite sides of the bottom housing 30 are received in the guiding recesses 32 with the wedges 122 buckling with the buckling recesses 33. The fixing rails 121 located between pegs 15 are received in the fixing holes 35 with the wedges 122 buckling with the guiding blocks 351 for fixing the top housing 10 on the bottom housing 30.

As described above, the fixing slice 211 is received in the holding recess 131, the base slice 24 is received in the fixing recess 141, so as to fix the terminal 20 firmly in the top housing 10. The elastic arm 22 rests against the resting portion 132 for preventing the deformation of the terminal 20 affected by the pulling of the contacting portion 25 by an external force.

What is claimed is:

1. A connector, comprising:

a top housing recessed to form a plurality of receiving passages therethrough, two sides of a bottom of the receiving passage recessed outward to form at least one pair of fixing recesses, one end of the receiving passage having a top portion protruding inward to form a resting portion; and a plurality of terminals mounted in the receiving passages each having a holding slice located at a bottom of the receiving passage, the holding slice having lateral sides extended outward to form at least one pair of fixing slices fixed in the holding recesses, one end of the holding slice connected with an elastic arm of substantially inverted-V shape with an opening facing to the holding slice, the elastic arm having a lower portion adjacent to a joint between the elastic arm and the holding slice resting against a bottom of the resting portion.

2. The connector as claimed in claim 1, further comprising a bottom housing coupled with the top housing, the top housing having a plurality of fixing portions protruded at a bottom thereof and adjacent to one end of the respective receiving passages, a surface of the fixing portion facing the receiving passage defining a fixing recess penetrating a top and a bottom of the fixing portion, the bottom housing defining a plurality of receiving holes for receiving the respective fixing portions, the terminal further including a base slice extended downward from the other end of the holding slice and received in the respective fixing recess.

3. The connector as claimed in claim 2, wherein a bottom of the base slice extends opposite to the holding slice to form an extending slice located at a bottom of the fixing portion and held in a bottom of the receiving hole, a free end of the extending slice extends downward to form a soldering slice penetrating and exposed outside the bottom housing.

4. The connector as claimed in claim 2, wherein lateral sides of the base slice are formed with barbs interfering with the fixing recess for fixing the base slice in the fixing recess.

* * * * *